United States Patent [19]

Siga et al.

[11] 4,332,889

[45] Jun. 1, 1982

[54] POST-ACTIVATION TYPE DRY IMAGE FORMING MATERIAL

[75] Inventors: Tetsuo Siga; Shozo Kinoshita; Yoshinobu Ito, all of Fuji; Minoru Akiyama, Yokohama, all of Japan

[73] Assignee: Asahi Kasei Kogyo Kabushiki Kaisha, Osaka, Japan

[21] Appl. No.: 265,011

[22] Filed: May 19, 1981

[30] Foreign Application Priority Data

May 23, 1980 [JP] Japan ..... 55-67748

[51] Int. Cl.[3] ..... G03C 1/02

[52] U.S. Cl. ..... 430/583; 430/349; 430/353; 430/394; 430/588; 430/619; 430/620

[58] Field of Search ..... 430/349, 353, 394, 583, 430/588, 619, 620

[56] References Cited

U.S. PATENT DOCUMENTS

| | | | |
|---|---|---|---|
| 3,764,329 | 10/1973 | Lee | 430/619 |
| 3,802,888 | 4/1974 | Willits | 430/620 |
| 3,816,132 | 6/1974 | Takegawa et al. | 430/394 |
| 3,933,507 | 1/1976 | Von Konig et al. | 430/620 |
| 4,234,679 | 11/1980 | Akashi et al. | 430/619 |
| 4,287,295 | 9/1981 | Nonaka et al. | 430/349 |

FOREIGN PATENT DOCUMENTS

| | | |
|---|---|---|
| 53-41967 | 8/1978 | Japan . |
| 54-5685 | 3/1979 | Japan . |

*Primary Examiner*—J. Travis Brown

*Attorney, Agent, or Firm*—Sprung, Horn, Kramer & Woods

[57] ABSTRACT

A novel heat-activatable and heat-developable dry image forming material comprising (a) a silver salt of long chain fatty acid with at least 16 carbon atoms, (b) a reducing agent for silver ions, (c) a silver halide component including silver iodide or a silver halide-forming component including silver iodide-forming compound, (d) an oxidizing agent for free silver, (e) a photoreactive halogeno oxidizing agent, (f) a binder, and (g) a specific spectral sensitizing dye has been found to have improved spectral sensitivity as well as excellent storage stability.

25 Claims, 2 Drawing Figures

POST-ACTIVATION TYPE DRY IMAGE FORMING MATERIAL

Figure 1:
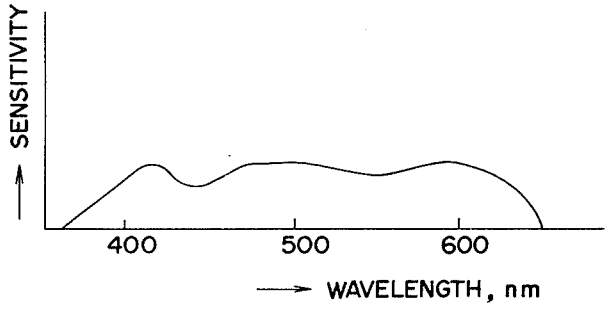

This invention relates to a dry image forming material. More particularly, the present invention relates to a post-activation type dry image forming material which is nonphotosensitive under normal lighting conditions but is rendered so photosensitive by preliminary heating (heat activation) as to be capable of recording thereon a latent image and therefore, after activation, can form thereon a visible image by only a dry process comprising the step of image-wise exposure to light and the step of heat development, and which is improved in spectral sensitivity without being spoiled in such properties characteristic of imaging materials of post-activation type as capability of being stored even in a light room before image formation. If a raw image forming material which is not yet subjected to image formation can be stored even in a light room like a raw dry image forming material according to the present invention, it is possible that, after information is recorded in the form of an image on a desired area of the image forming material, new information can be recorded in the form of an additional image on another desired area of the image forming material at some convenient time. As desired, a copy of the material having the first information can be obtained by means of a copying machine such as a duplicator or a printer. It is needless to say that updated information can be recorded in the form of a further image on still another desired area of the image forming material as far as the image forming material has blank areas in which it is not yet subjected to image formation. Since the dry image forming material of the present invention is increased in spectral sensitivity, it can form thereon an image by photographing even a manuscript having a colored background or a colored image. Despite the increased sensitivity, the image forming material of the present invention is so stable as to enable additional information to be recorded thereon in a practical sense.

As silver salt photographic materials on which an image can be formed by a dry process only, there have heretofore been proposed dry image forming materials comprising an organic silver salt oxidizing agent, a reducing agent for silver ions and a catalytic amount of a silver halide. Examples of such dry image forming materials include post-activation type dry image forming materials disclosed in U.S. Pat. Nos. 3,802,888 and 3,764,329, and Japanese Patent Publication Nos. 41967/1978 and 5685/1979, wherein the incorporation of a spectral sensitizing dye into a dry image forming material is mentioned. These proposed post-activation type dry image forming materials, however, are defective either in that they are so poor in light or storage stability of the raw image forming materials as to undergo marked deterioration in their photographic or sensitometric characteristics when stored under normal lighting conditions or when exposed to high temperatures even if stored in the dark, or in that they are too insufficient in sensitivity to be used in photographing. As the storage stability of a raw image forming material is increased, the sensitivity of the material is decreased, whereas the storage stability of a raw image forming material is decreased as the sensitivity of the material is increased. Therefore, none of the conventional post-activation type dry image forming materials are so good in both stability and sensitivity as to meet such a demand that the materials record thereon necessary information and even additional information in the form of visible images at desired places and times by a time-saving dry process only.

It is, therefore, an object of the present invention to provide a practically usable post-activation type dry image forming material excellent enough in both stability and sensitivity to meet the above-mentioned demand and capable of recording thereon additional information.

It is well known to those skilled in the art that it is very difficult to apply the knowledge and technique acquired and the various additives used in the field of wet process silver halide photographic materials to the field of dry process photographic or image-forming materials comprising as the essential components an organic silver salt oxidizing agent, a reducing agent for silver ions and a silver halide catalyst because both types of the materials are quite different in components and mechanism of image formation. It is particularly noted that post-activation type dry image forming materials, which are required to be capable of being exposed to or stored under normal lighting conditions substantially without undergoing deterioration in their photographic or sensitometric characteristics, are quite different in conditions of storage and image formation from the wet process photographic materials and even common heat-developable dry image forming materials of the already photosensitive type which are never exposed to light prior to use in image formation. Therefore, it is quite impossible to anticipate whether or not an additive suitable for the wet process photographic materials or the common dry image forming material of the already photosensitive type can be used successfully in post-activation type dry image forming materials. In fact, it is rather natural that such an additive be unable to be used in a post-activation type dry image forming material since incorporation of the additive into the post-activation type dry image forming material quite often results in low light or storage stability of the raw dry image forming material. For example, as is disclosed in Japanese Pat. Publication No. 25498/1974 and U.S. Pat. No. 3,933,507, incorporation of a spectral sensitizing dye into a system comprising an organic silver salt oxidizing agent and a reducing agent for silver ions but no photosensitive silver halide results in a dry image forming material of the already photosensitive type. As will be easily understood from this instance, a spectral sensitizing dye incorporated into an image forming system has a tendency to impart photosensitivity to the system. Accordingly, in the case of a post-activation type dry image forming material which is required to be capable of being exposed to light prior to use and of being preliminarily heated prior to image-wise exposure to light substantially without deterioration of its photographic or sensitometric characteristics and not to undergo substantial fogging, a spectral sensitizing dye, if incorporated into the material, generally downgrades drastically the light or storage stability of the raw image forming material and renders the material more subject to fogging.

On the other hand, in the case of wet process silver halide photographic materials and common heat-developable dry image forming materials of the already photosensitive type, spectral sensitizing dyes as commonly used in these materials are not necessarily required to be stable to light irradiation and heating since the materials are never exposed to light and heat prior to use for image formation. In fact, unstable spectral sensitizing dyes are widely used in the above-mentioned materials.

Almost all of the attempts to use in post-activation type dry image forming materials spectral sensitizing dyes as commonly used in the wet process silver halide photographic materials and the common heat-developable dry image forming materials of the already photosensitive type have failed either because the spectral sensitizing dyes adversely affects the stability of the resulting raw post-activation type dry image forming materials so that they cause the resulting dry image forming materials to undergo fogging at the step of preliminary heating prior to light exposure and the escalation of the fogging at the step of heat development, or because the spectral sensitizing dyes themselves are so decomposed or bleached in the post-activation type dry image forming materials as not to exhibit any spectrally sensitizing capability from the outset, or as to lose their spectrally sensitizing capability too rapidly to be practically useful.

It is, therefore, another object of the present invention to provide a post-activation type dry image forming material of the character as described before, which is spectrally sensitized, but neither substantially undergoes such fogging caused by light irradiation or heating prior to use for image formation as will be attributable to the inclusion of a spectral sensitizing dye, nor involves any substantial loss of the spectrally sensitizing capability of a spectral sensitizing dye owing to the decomposition or bleaching of the spectral sensitizing dye.

Figure 2:
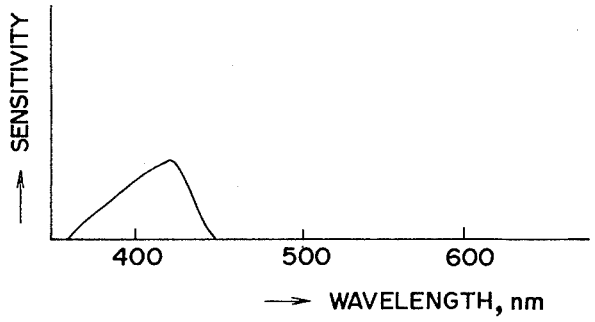

The foregoing and other objects, features and advantages of the present invention will be apparent to those skilled in the art from the following detailed description and appended claims taken in connection with the accompanying drawing in which:

FIG. 1 is a spectral sensitivity curve of a post-activation type dry image forming material according to the present invention prepared in Example 31; and FIG. 2 is a spectral sensitivity curve of a comparative post-activation type dry image forming material prepared in Comparative Example 31.

We have made extensive and intensive investigations with a view to developing a post-activation type dry image forming material spectrally sensitized in a practical sense and having high sensitivity as well as excellent light or storage stability of raw material to find that such a post-activation type dry image forming material can be obtained when it includes peculiar oxidizing compounds [components (d) and (e) mentioned below] capable of providing a strongly oxidizing atmosphere unlike those in the case of wet process silver halide photographic materials and common heat-developable dry image forming materials of the already photosensitive type, and a specific spectral sensitizing dye having a unique chemical structure. We have completed the invention based on such a finding.

More specifically, in accordance with the present invention, there is provided a post-activation type dry image forming material comprising:

(a) a silver salt of long chain fatty acid having 16 or more carbon atoms;

(b) a reducing agent for silver ions;

(c) a silver halide component including silver iodide or a silver halide-forming component capable of forming a silver halide component including silver iodide by the reaction thereof with said silver salt of long chain fatty acid (a);

(d) an oxidizing agent for free silver;

(e) a photoreactive halogeno oxidizing agent;

(f) a binder; and (g) a spectral sensitizing dye consisting of at least one member selected from the group consisting of those compounds represented by the following formulae:

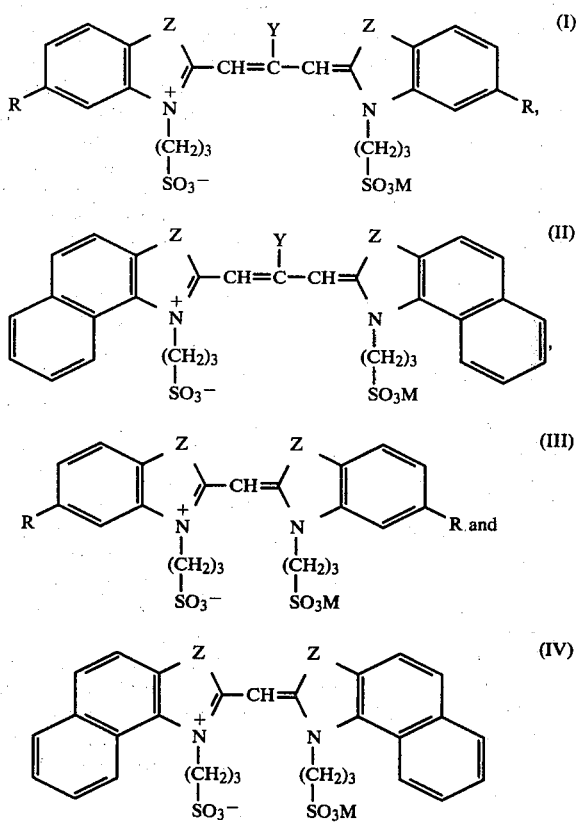

wherein each Z independently is sulfur or selenium, Y is hydrogen or methyl, each R independently is hydrogen or chlorine, and M is hydrogen, $HN(C_2H_5)_3$ or sodium.

The post-activation type dry image forming material of the present invention is improved in stability of the material prior to heat activation, i.e., stability of the raw image forming material, as well as sensitivity. The reason for this is believed to be as follows. In the post-activation type dry image forming material, the silver halide component present therein as the component (c) prior to heat activation of the material is photochemically reduced by the action of light during the storage of the raw image forming material in a light room to form free silver in part in the silver halide crystals. The free silver thus formed, if left as it is, would exert a catalytic activity for promoting the reduction reaction of the silver salt of long chain fatty acid (a) capable of making a visual change. However, the free silver is oxidized by the action of the free silver-oxidizing agent (d) to reconvert the free silver into the original silver halide, leading to extinguishment of the above-mentioned catalytic activity to be exerted by the free silver. The free silver-oxidizing agent (d) having served to oxidize the free silver to the silver halide, itself, is in a reduced state. The reduced free silver-oxidizing agent (d), in turn, is oxidized by the photochemical action of the photoreactive halogeno oxidizing agent (e) so that it is returned to the original state to regenerate the capacity of oxidizing free silver. As is clearly understood from the foregoing explanation, a main reason for the excellent stability of the raw image forming material (material prior to heat activation) is believed to be that the component (d) reduced by having served to reconvert the light-produced free silver into the silver halide component is regenerated (oxidized) by the action of the component (e) during the course of storage.

Silver iodide is superior in thermal stability to silver bromide and silver chloride. Further, the free silver formed in silver iodide crystals has a low redox potential and therefore is easily oxidized as compared with those produced in silver bromide crystals and silver chloride crystals. Accordingly, the inclusion of silver iodide in the silver halide component (c) enables the free silver photochemically produced in part in silver halide crystals to be easily oxidation-reconverted into the original silver halide by the action of the free silver-oxidizing agent (d). Both of the above-mentioned low redox potential of the free silver formed in silver iodide crystals and the thermal stability of silver iodide contribute to excellent stability of the raw material of the present image forming material containing silver iodide.

Under a strongly oxidizing atmosphere provided in the post-activation type dry image forming material of the present invention, those compounds of the formula (I), (II), (III) or (IV) usable as the spectral sensitizing dye (g) do not act in favor of imparting a photosensitivity to the material, which also contributes, together with the high stability of the compounds themselves, to excellent stability of the raw material.

It is needless to say that an light- or heat-unstable silver source for silver image formation is unsuitable for use in the post-activation type dry image forming material of the present invention. For instance, when a silver complex of imidazole, pyrazole, urazol, 1,2,4-triazole or 1H-tetrazole, or a silver salt of lower fatty acid is used in place of the silver salt of long chain fatty acid (a), the resulting dry image forming material is unsatisfactory in stability of the raw material.

As the silver salt of long chain fatty acid (a) having 16 or more carbon atoms to be used in the post-activation type dry image forming material of the present invention, there can be mentioned, for example, silver palmitate, silver margarate, silver stearate, silver arachidate, silver behenate, silver cerotate and silver melissinate. Silver behenate is most useful. They may be used either alone or in combination. The silver salt of long chain fatty acid may be used in an amount of about 0.1 to about 50 g/m$^2$, preferably 1 to 10 g/m$^2$ of the support area of the present image forming material.

As the reducing agent for silver ions (b) to be used in the post-activation type dry image forming material of the present invention, there is used an organic reducing agent which has a suitable reducing ability that, when heated, it reduces the non-photosensitive long chain fatty acid silver salt (a) with the aid of catalysis of the free silver produced in the exposed portions of the activated dry image forming material to form a visible silver image. Examples of the silver ion-reducing agents include monohydroxybenzenes such as p-phenylphenol, p-methoxyphenol, 2,6-di-tert-butyl-4-methylphenol and 2,5-di-tert-4-methoxyphenol; polyhydroxybenzenes such as hydroquinone, tert-butylhydroquinone, 2,6-dimethylhydroquinone, chlorohydroquinone and catechol; naphthols such as $\alpha$-naphthol, $\beta$-naphthol, 4-aminonaphthol and 4-methoxynaphthol; hydroxybinaphthyls such as 1,1'-dihydroxy-2,2'-binaphthyl and 4,4'-dimethoxy-1,1'-dihydroxy-2,2'-binaphthyl; phenylenediamines such as p-phenylenediamine and N,N'-dimethyl-p-phenylenediamine; aminophenols such as N-methyl-p-aminophenol and 2,4-diaminophenol; sulfonamidophenols such as p-(toluenesulfonamido)phenol and 2,6-dibromo-4-(p-toluenesulfonamido)phenol; methylenebisphenols such as 2,2'-methylenebis(4-methyl-6-tert-butylphenol), 2,2'-methylenebis(4-ethyl-6-tert-butylphenol), 2,2'-methylenebis[4-methyl-6-(1-methylcyclohexyl)phenol], 1,1-bis(2-hydroxy-3,5-dimethylphenyl)-3,5,5-trimethylhexane and 2,6-bis(2'-hydroxy-3'-tert-butyl-5'-methylbenzyl)-4-methylphenol; 3-pyrazolidones such as 1-phenyl-3-pyrazolidone and 4-methyl-4-hydroxymethyl-1-phenyl-3-pyrazolidone; and ascorbic acids. A suitable reducing agent may be chosen depending on the kind of silver salt of long chain fatty acid (a) employed in combination therewith. Preferred are phenols. More preferred are hindered phenols in which one or two sterically bulky groups are bonded to the carbon atom or carbon atoms contiquous to the hydroxyl group-bonded carbon atom to sterically hinder the hydroxyl group. Such hindered phenols have a high stability to light and, hence, the use thereof is effective for assuring a high storage stability of the raw dry image forming material of the post-activation type. As examples of such hindered phenols, there can be mentioned 2,6-di-tert-butyl-4-methylphenol, 2,2'-methylenebis(4-methyl-6-tert-butylphenol), 2,2'-methylenebis(4-ethyl-6-tert-butylphenol), 2,4,4-trimethylpentylbis(2-hydroxy-3,5-dimethylphenyl)methane (i.e., 1,1-bis(2-hydroxy-3,5-dimethylphenyl)-3,5,5-trimethylhexane), 2,6-methylenebis-(2-hydroxy-3-tert-butyl-5-methylphenyl)-4-methylphenol, 2,2'-methylenebis[4-methyl-6-(1-methylcyclohexyl)phenol] and 2,5-di-tert-butyl-4-methoxyphenol. These reducing agents may be used either alone or in combination. The suitable amount of the reducing agent is usually in the range of from 0.1 to 3 moles per mol of the silver salt of long chain fatty acid (a).

It is requisite for the purpose of the present invention that the silver halide component (c) or the silver halide component formed from the silver halide-forming component (c) include therein silver iodide. In order for the silver iodide to exert a sufficient effect for the purpose, it is preferable that silver iodide be included in an amount of at least 30 mole % based on the silver halide component. The more preferable amount of silver iodide is at least 50 mole % based on the silver halide component. From the viewpoint of sensitivity of the image forming material, the silver halide component is desired to contain, besides silver iodide, at least 2 mole %, based on the silver halide component, of silver bromide and/or silver chloride, although the silver halide component may include only silver iodide, i.e. 100 mole % of silver iodide. Furthermore, from the viewpoint of stability of the raw image forming material, it is desirable that the silver halide component contain, besides silver iodide, silver bromide rather than silver chloride. Therefore, the most preferred silver halide component consists of silver iodide and silver bromide. In this case, silver iodide and silver bromide may be provided in the form of either a mixture thereof or mixed crystals thereof. The molar ratio of silver iodide to silver bromide may be preferably 30/70 to 98/2, more preferably 50/50 to 95/5. The preferred amount of the silver halide component to be used is 0.1 to 20 mole %, based on the amount of the silver salt of long chain fatty acid (a).

Silver iodide and any other silver halide(s) as prepared by the known method commonly employed in the field of photograhic film manufacture may be formulated as the silver halide component (c), together with other components such as the silver salt of long chain fatty acid, into a composition for providing the image forming coating or layer of the dry image forming material, as is disclosed in U.S. Pat. No. 3,152,904. Alternatively, silver iodide and any other silver halide(s) can be prepared in situ either in a composition for providing the image forming coating of the dry image forming material or in the coated image forming layer of the dry image forming material, by the reaction of a silver halide-forming component (c) with part of the long chain fatty acid silver salt (a), as is disclosed in U.S. Pat. No. 3,457,075. The latter mode is preferred in which silver iodide and any other silver halide(s) are formed by the reaction between the long chain fatty acid silver salt (a) and the silver halide-forming component (c), which is a kind of halogenating agent.

As the suitable halogenating agent to be used as the silver halide-forming component (c) in the latter mode mentioned above, there can be mentioned organic halides of elements belonging to Group IV, V or VI of the periodic table and having an atomic number of 14 or more, the preferred elements being Ge, Sn, P, Bi, Te and Se, (see U.S. Pat. No. 4,113,496); halogen molecular species and complexes thereof (see U.S. Pat. No. 4,173,482); organic N-haloamides containing a unit of the formula -CONX- wherein X is bromine or iodine (see U.S. Pat. No. 3,764,329); aryl-halomethanes (see U.S. Pat. No. 4,188,266); and metal halides. They may be used either alone or in combination. Preferred are halogen molecular species and complexes thereof, and organic N-haloamides, from the viewpoint of stability of the raw image forming material. Specific examples of the halogenating agent include compounds respectively represented by the formulae:

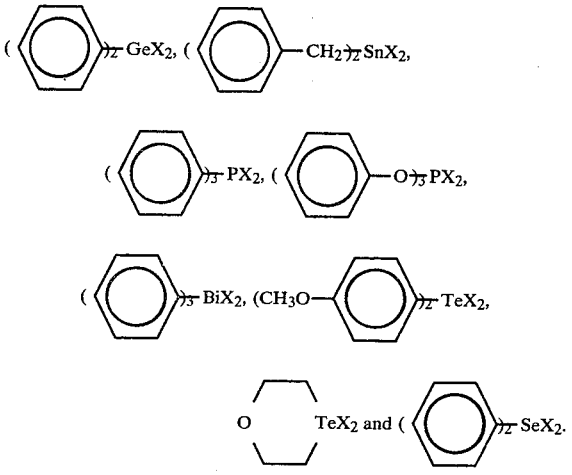

In the above formulae, X is bromine or iodine. Further specific examples of the halogenating agent include iodine, bromine, iodine bromide, a complex of triphenyl phosphite and iodine, a complex of p-dioxane and iodine, a complex of p-dioxane and bromine, N-bromo(or -iodo)phthalimide, N-bromo(or -iodo)succinimide, N-bromo(or -iodo)phthalazinone, N-bromo(or -iodo)acetamide, N-bromo(or -iodo)acetanilide and α-bromo(or -iodo)diphenylmethane. Still further specific examples of the halogenating agent include $CoX_2$, $NiX_2$, $MgX_2$, $BaX_2$, RbX, CsX, $TeX_2$, $TeX_4$ and $AsX_3$. In these formulae, X is bromine or iodine. From the viewpoint of stability of the raw image forming material as well as sensitivity, the preferred halogenating agents for forming silver iodide are iodine and N-iodosuccinimide. Complexes of iodine such as a complex of triphenyl phosphite and iodine and a complex of p-dioxane and iodine are also preferred. In the case of N-iodosuccinimide, it is preferred that a solution of N-iodosuccinimide in an alcohol such as methanol or ethanol, which has been previously prepared, be incorporated into an emulsion for the desired dry image forming material. From the viewpoint of sensitivity as well as stability of the raw image forming material, the preferred halogenating agents for forming silver bromide are N-bromosuccinimide, cobalt dibromide, nickel dibromide and α-bromodiphenylmethane. The amount, in equivalents, of the halogenating agent to be used may be equal to or more than the desired amount, in equivalents, of the silver halide component.

The oxidizing agent for free silver (d) to be used in the post-activation type dry image forming material of the present invention has a capacity of oxidizing free silver produced during the storage of the material, thereby contributing to improving the stability of the raw material. As examples of the free silver-oxidizing agent (d), there can be mentioned compounds of divalent mercury ($Hg^{++}$), compounds of trivalent iron ($Fe^{+++}$), compounds of trivalent cobalt ($Co^{+++}$), compounds of divalent palladium ($Pd^{++}$) and sulfinic acid compounds. As examples of the compounds of divalent mercury, there can be mentioned mercuric salts of aliphatic carboxylic acids such as mercuric acetate and mercuric behenate; mercuric salts of aromatic carboxylic acids such as mercuric benzoate, mercuric m-methylbenzoate and mercuric acetamidobenzoate; mercuric halides such as mercuric bromide and mercuric iodide; mercuri-benzotriazole; and mercuri-phthalazinone. Preferred are mercuric acetate, mercuric bromide and mercuric iodide. As examples of the compounds of trivalent iron, there can be mentioned a complex of trivalent iron and acetylacetone and a complex of trivalent iron and bipyridyl. As examples of the compounds of trivalent cobalt, there can be mentioned a complex of trivalent cobalt and acetylacetone and a complex of trivalent cobalt and o-phenanthroline, and cobaltic halides such as cobaltic iodide and cobaltic bromide. Examples of the compounds of divalent palladium include a complex of divalent palladium and acetylacetone, and palladium (II) halides such as palladium (II) iodide and palladium (II) bromide. As examples of the sulfinic acid compound, there can be mentioned n-octylsulfinic acid and p-toluenesulfinic acid. As the component (d), the compounds of divalent mercury are most preferred. The preferred amount of the component (d) is in the range of from 0.01 to 10 mole % based on the silver salt of long chain fatty acid.

As described before, the oxidizing agent for free silver [component (d)] is reduced by serving to oxidize the free silver produced during the storage of the raw image forming material into the original silver halide. The thus reduced oxidizing agent for free silver, in turn, is oxidized, under lighting conditions, by the action of the photoreactive halogeno oxidizing agent (e), whereby it is effectively returned to the original state in which the component (d) has a capacity of oxidizing free silver. The photoreactive halogeno oxidizing agent is such a halogeno compounds as can generate free radicals of halogen upon light exposure. Preferred examples of such a halogeno compound are halogenated organic compounds having bromine- and/or iodine-carbon linkages.

Whether or not a given halogeno compound is suitable for use as the component (e) in the present invention can be determined, for example, by the following photoreaction test.

1 Mole of silver behenate [suitable as the silver behenate is one which has been synthesized in a mixed solvent (1:5–5:1 by volume) of water and at least one water-soluble or partially water-soluble alcohol having 3 to 8 carbon atoms], 450 g of polyvinyl butyral and 0.25 mole of said given halogeno compound for use as the "photoreactive halogeno oxidizing agent" are dissolved into a mixed solvent (2:1 by weight) of methyl ethyl ketone and toluene, and then formed into a film according to an ordinary casting method.

The film thus formed is tested with respect to the following two requirements. When the film satisfies both of the requirements, the halogeno compound (for use as the photoreactive oxidizing agent) employed is suitable for the purpose of the present invention.

Requirement 1: when the film is examined by X-ray diffractometry, the peak due to silver bromide ($2\theta=31.0°$) or the peak due to silver iodide ($2\theta=23.7°$) should not substantially be observed [the relative intensity of said peak is less than about 10 when the relative intensity of the peak due to silver behenate ($2\theta=12.1°$) is defined as 100].

Requirement 2: subsequently, the film is irradiated with a light (0.5 mW/cm$^2$) emitted from a black lamp in an atmosphere having a temperature of 50° C. and a relative humidity of 80% for 2 hours, and then examined by X-ray diffractometry again. The peak due to silver bromide ($2\theta=31.0°$) or the peak due to silver iodide ($2\theta=23.7°$) should be substantially observed [the relative intensity of said peak is about 10 or more when the relative intensity of the peak due to silver behenate ($2\theta=12.1°$) is defined as 100].

In the above test, the values of $2\theta$ are those of diffraction peaks obtained by using $CuK_\alpha$ line. In the present invention, as the apparatus for X-ray diffractometry is used an apparatus of Rotor Unit type (RU-200 PL type) manufactured and sold by Rigaku Denki Kabushiki Kaisha, Japan.

Specific examples of halogeno compounds capable of being used as the photoreactive halogeno oxidizing agent (e) include α,α,α′,α′-tetrabromo-o-xylene, α,α,α′-,α′-tetrabromo-m-xylene, ethyl α,α,α-tribromoacetate, α,α,α-tribromoacetophenone, α,α,α-tribromo-p-bromotoluene, 1,1,1-tribromo-2,2-diphenylethane, tetrabromomethane, meso-1,2,3,4-tetrabromobutane, 2,2,2-tribromoethanol, 2,2,2-tribromoethylcyclohexyl carbamate, 2,2,2-tribromoethylphenyl carbamate, 2,2,2-tribromoethyl benzoate, 2,2,2-tribromoethyl ethylcarbamate, 2-methyl-1,1,1-tribromo-2-propanol, bis(2,2,2-tribromoethoxy) diphenylmethane, 2,2,2-tribromoethyl stearate, 2,2,2-tribromoethyl-2-furoate, bis(2,2,2-tribromoethyl) succinate, 2,2,2-tribromoethyl phenylsulfonate, 2,2,2-tribromoethoxytrimethyl-silane, 2,2,2-tribromo-1-phenylethanol, 2,2,2-tribromoethyldiphenyl phosphate, 1,2-diiodoethane and iodoform. They may be employed either alone or in combination. Of them, the bromo compounds are preferred since they give little coloring and improved stability to the resulting raw dry image forming material. Especially preferred are α,α,α′,α′-tetrabromo-o-xylene, α,α,α′,α′-tetrabromo-m-xylene, ethyl α,α,α-tribromoacetate, α,α,α-tribromo-p-bromotoluene, α,α,α-tribromoacetophenone, 1,1,1-tribromo-2,2-diphenylethane, 2,2,2-tribromoethanol and meso-1,2,3,4-tetrabromobutane. Most preferred are α,α,α′,α′-tetrabromo-o-xylene and α,α,α′,α′-tetrabromo-m-xylene. The amount of the photoreactive halogeno oxidizing agent (e) is preferably 2.5 to 40 mole %, based on the silver salt of long chain fatty acid (a).

As the binder (f) to be used in the dry image forming material of the present invention, there can be mentioned, for example, film-forming polymer materials such as, polyvinyl butyral, polymethyl methacrylate, cellulose acetate, polyvinyl acetate, cellulose acetate propionate, cellulose acetate butyrate, vinyl chloride-vinyl acetate copolymers, polyvinyl alcohol, polystyrene, polyvinyl formal and gelatin. Polyvinyl butyral is the most preferred binder. They may be used either alone or in combination. It is preferred that the binder be used in such an amount that the weight ratio of the binder to the long chain fatty acid silver salt (a) is in the range of from about 0.1 to about 10.

The spectral sensitizing dye (g) to be used in the dry image forming material of the present invention is selected from those compounds each represented by one of the general formulae (I), (II), (III) and (IV) mentioned hereinbefore. The amount of the component (g) is preferably in the range of from 0.001 to 1 mole %, based on the component (a).

Specific examples of the component (g) include the following compounds:

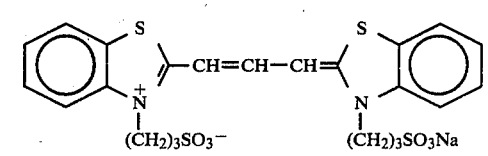

(1)

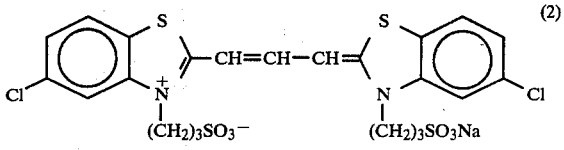

(2)

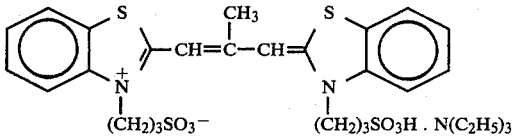

(3)

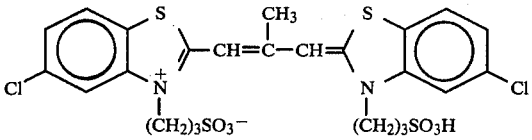

(4)

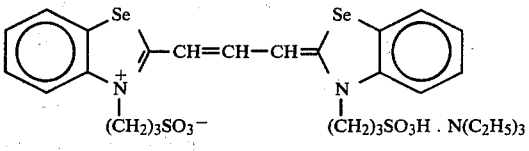

(5)

-continued
(6)
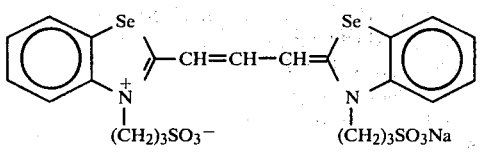
(7)
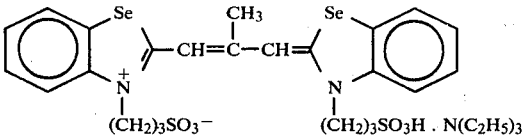
(8)
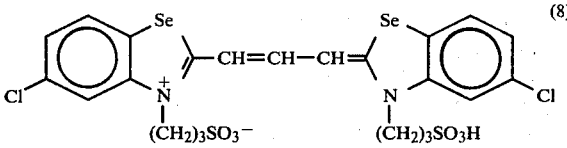
(9)
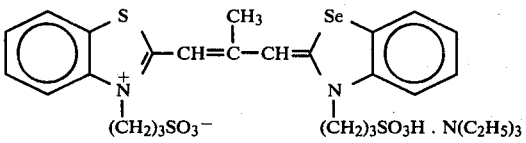
(10)
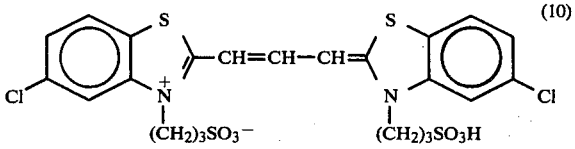
(11)
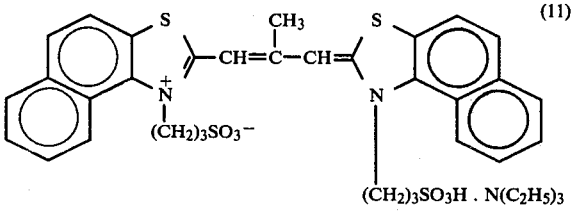
(12)
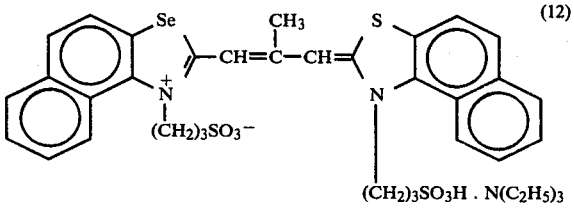
(13)
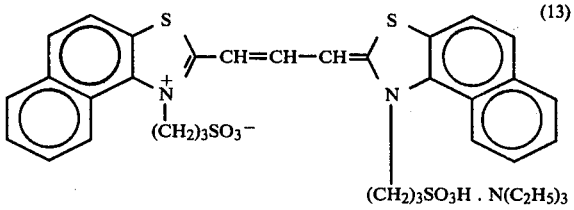
(14)
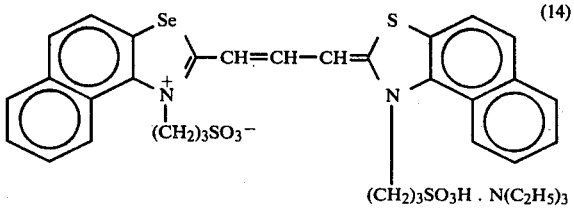
-continued
(15)
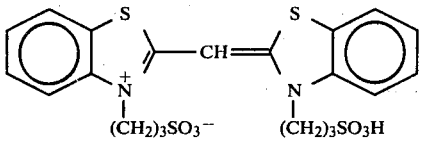
(16)
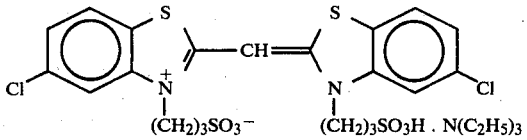
(17)
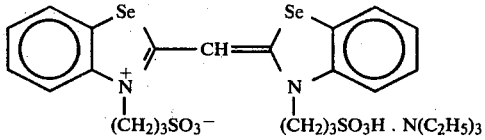
(18)
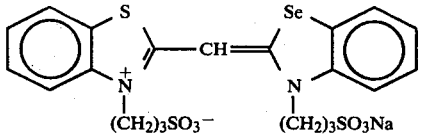
(19)
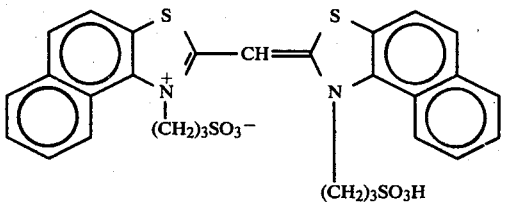
(20)
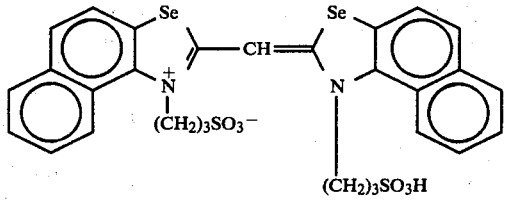
(21)
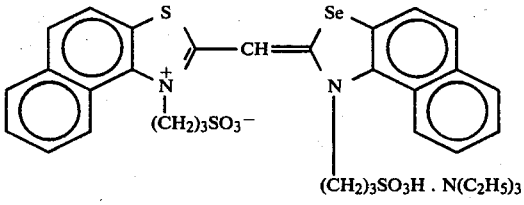
(22)
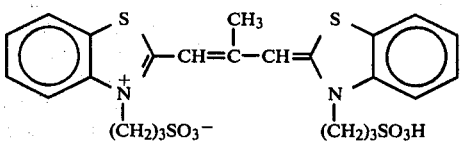
(23)
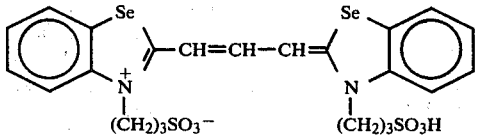

According to need, the post-activation type dry image forming material of the present invention may comprise in addition to the foregoing essential components a variety of additives such as a chemical sensitizer, a toner for a silver image and/or a development promotor.

Among chemical sensitizers which improve the sensitivity of the dry image forming material of the present invention, those liable to spoil greatly the storage stability of the dry image forming material prior to the use thereof are not preferred. As chemical sensitizers which substantially improve the sensitivity of but not substantially spoil the storage stability of the dry image forming material of the present invention, there can be mentioned, for example, amide compounds as disclosed in Japanese Patent Application Laid-Open Specification No. 7914/1976, e.g. 1-methyl-2-pyrrolidone; quinoline compounds as disclosed in Deutsche Offenlegungsschrift No. 2,845,187 and represented by the following general formula:

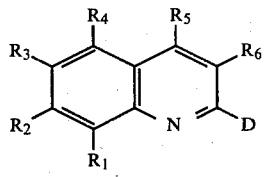

wherein $R_1$, $R_2$, $R_3$, $R_4$ $R_5$ and $R_6$, each independently, is a hydrogen atom, an aryl group selected from phenyl and naphthyl groups unsubstituted or substituted with methyl, methoxy or halogen, a $C_1$–$C_{10}$ straight or branched chain alkyl group, a $C_1$–$C_4$ alkoxyl group, an aralkyl group selected from benzyl and phenethyl groups unsubstituted or substituted with methyl, methoxy or halogen, a hydroxyl group, a cyano group, a carboxyl group, a $C_2$–$C_5$ alkoxycarbonyl group, a nitro group, an amino group or a carbamoyl group, and D is a hydrogen atom, a hydroxyl group or an amino group; and 3-pyrazolin-5-one compounds as disclosed in Deutshe Offenlegungsschrift No. 2,934,751 and represented by the following formula:

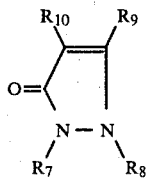

wherein $R_7$ is a hydrogen atom, a $C_1$–$C_5$ straight or branched chain alkyl group, an unsubstituted or substituted phenyl group or an unsubstituted or substituted $C_3$–$C_8$ cycloalkyl group, $R_8$ is a $C_1$–$C_5$ straight or branched chain alkyl group, an unsubstituted or substituted phenyl group or an unsubstituted or substituted $C_3$–$C_8$ cycloalkyl group, and $R_9$ and $R_{10}$ are the same or different and each represents a hydrogen atom, a $C_1$–$C_5$ straight or branched chain alkyl group, an unsubstituted or substituted phenyl group or an unsubstituted or substituted phenylalkyl group having a $C_1$–$C_5$ straight or branched chain alkyl moiety. They may be used either alone or in combination preferably in an amount of 5 to 50 mole %, based on the silver salt of long chain fatty acid (a). Specific examples of 3-pyrazolin-5-one compounds include 2-phenyl-3-pyrazolin-5-one, 1-(p-iodophenyl)-2,3-dimethyl-3-pyrazolin-5-one, 2,3,4-triphenyl-3-pyrazolin-5-one, 1-phenyl-2,3-dimethyl-3-pyrazolin-5-one, 1,3-diethyl-2-phenyl-3-pyrazolin-5-one, 2,3-dimethyl-1-ethyl-4-isopropyl-3-pyrazolin-5-one, 2-o-tolyl-3-methyl-4-ethyl-3-pyrazolin-5-one, 2-cyclohexyl-3-pyrazolin-5-one, 2-methyl-1,3-diphenyl-3-pyrazolin-5-one and 1-cyclohexyl-2,3-dimethyl-3-pyrazolin-5-one. The post-activation type dry image forming material of the present invention, even when containing a chemical sensitizer as mentioned above for improving the sensitivity, exerts the effects as intended in the present invention.

As the toner for a silver image, there can be mentioned, for example, phthalazinone, zinc acetate, cadmium acetate, phthalimide and succinimide. They may be used either alone or in combination. The amount of the toner for a silver image is preferably in the range of from 1 to 100 mole %, based on the component (a).

The preferred method of preparing the dry image forming material of this invention is described by way of example as follows. An silver salt of long chain fatty acid is dispersed in a binder-forming polymer solution by means of a ball mill, a homogenizer, a mixer, a sand mill or the like. To the resulting dispersion are added the other essential components and optionally various additives. The composition thus obtained is applied onto a support such as a plastic film, a glass plate, a paper or a metal plate, followed by drying, to prepare a dry image forming material. As the plastic film, there can be mentioned a polyethylene film, a cellulose acetate film, a polyethylene terephthalate film, a polyamide film, a polypropylene film and the like. The dry thickness of the coating as the image forming layer may be 1 to 100$\mu$, preferably 3 to 20$\mu$. The essential components of the image forming material of the present invention may be applied either in one layer as described above, or in two or more separate but contiguous layers, for example, as will be described below.

[1] A composition containing the components (a), (c), (d), (e) and (f) is applied onto a support, followed by drying, to form a first coating layer. Subsequently, a composition containing the components (b), (g) and (f) is applied onto the first coating layer and dried to form a second coating layer.

[2] A composition containing the components (a), (c), (d), (e), (f) and (g) is applied onto a support, followed by drying, to form a first coating layer. Subsequently, a composition containing the components (b) and (f) is applied onto the first coating layer and dried to form a second coating layer.

[3] A composition containing the components (a), (c), (d), (g) and (f) is applied onto a support, followed by drying, to form a first coating layer. Subsequently, a composition containing the components (b), (e) and (f) is applied onto the first coating layer and dried to form a second coating layer.

For the purposes of the protection of the heat-activatable and heat-developable image forming layer and so on, a top coat may be provided. The material for the top coat may be chosen from among the binder materials as mentioned hereinbefore. Since the post-activation type dry image forming material of the present invention is non-photosensitive under normal lighting conditions, the preparation, application to a support and subsequent drying of a composition or compositions containing the essential components may be carried out even in a light room, but preferably at a temperature of 50° C. or less.

The sheet material so prepared does not lose an image-forming capacity even if stored under normal lighting conditions and it can be handled in a light room. When a given area of this sheet material is heated in the dark, this area is rendered photosensitive. This preliminary heating is preferably carried out at a temperature of about 90° to about 130° C. As the heating temperature is elevated, the heating time may be proportionally shortened. When the area rendered photosensitive by heating is exposed imagewise to light and then heat-developed, a visible image is obtained. It is preferred that heat development be carried out at a temperature of about 90° to about 150° C. The heating time at the step of either preliminary heating or heat development may be controlled within the range of from about 1 to about 30 seconds. When the preliminary heating for rendering the material photosensitive and the heat development are conducted at the same temperature, the time for the heat development is generally equal to or longer than the time for the preliminary heating. In the image forming material of this invention, a visible image can be recorded selectively on a given area, and updated information may be additionally recorded on other area according to need. Furthermore, the image forming material of this invention can form thereon an image by photographing even a colored manuscript.

The following Examples illustrate the present invention in more detail but should not be construed as limiting the scope of the invention.

In the following Examples and Comparative Examples, the relative sensitivity and retention of sensitivity of dry image forming material are evaluated as follows.

The sensitivity of dry image forming material is defined to be expressed by the reciprocal of amount of exposure light required for giving an optical density (O.D.) 0.6 higher than the minimum optical density (O.D. min) of dry image forming material. Relative sensitivity (R.S.) is given herein in terms of a proportion of the sensitivity of dry image forming material relative to the sensitivity of a given dry image forming material whose relative sensitivity is defined as 100.

The retention of sensitivity is given herein in terms of a ratio of sensitivity of dry image forming material subjected to an accelerated deterioration test [using a fadeometer FX-1 (trade name of a product manufactured and sold by Suga Shikenki K. K., Japan) in Examples 1 to 18 and 23 to 30 and Comparative Examples 1 to 22 and 29 to 30 or a Duplifiche Printer 261 (trade name of a microfiche duplicator manufactured and sold by Minesota Mining and Manufacturing Company, U.S.A.) in Examples 19 to 22 and Comparative Examples 23 to 28] relative to sensitivity of the corresponding dry image forming material not subjected to the accelerated deterioration test.

EXAMPLES 1 TO 3 AND COMPARATIVE EXAMPLES 1 TO 6

To 20 g of a mixed solvent of toluene and methyl ethyl ketone (mixing weight ratio=1:2) was added 3 g of silver behenate, and the mixture was ball-milled for about 18 hours to obtain a homogeneous silver behenate suspension.

To 1.5 g of the silver behenate suspension were added ingredients [I] as shown below to form a silver behenate emulsion. The silver behenate emulsion was uniformly applied onto a 100 $\mu$-thick polyethylene terephthalate film at an orifice of 100$\mu$, and air-dried at room temperature (about 20° C.) to form a first coating layer. The amount of silver behenate contained in the first coating layer was about 4 g/m$^2$ of the layer. About 2 g of a reducing agent-containing composition composed of ingredients [II] as shown below was uniformly applied as a second coating layer onto the first coating layer at an orifice of 75$\mu$, and air-dried at room temperature (20° C.) to obtain a dry image forming material having a total coating layer thickness of about 12$\mu$.

| Ingredients [I] | |
|---|---|
| 15 Weight % solution of polyvinyl butyral in methyl ethyl ketone | 1.3 g |
| Solution of 100 mg of mercuric iodide in 9 cc of acetone | 0.5 cc |
| Bis-p-methoxyphenyltellurium diiodide | 28 mg |
| Bis-p-methoxyphenyltellurium dibromide | 14 mg |
| meso-1,2,3,4-Tetrabromobutane | 25 mg |
| Quinoline | 30 mg |
| Solution of 10 mg of dye compound as indicated in Table 1 in 10 cc of methanol | 0.1 cc |
| Ingredients [II] | |
| Cellulose acetate | 6.3 g |
| 2,6-Methylenebis(2-hydroxy-3-tert-butyl-5-methylphenyl)-4-methylphenol | 3.2 g |
| Acetone | 83.0 g |
| Phthalazinone | 1.2 g |

A piece of the dry image forming material was preliminarily heated on a hot plate maintained at about 100° C. for 3 seconds in a dark room. Then, the material was exposed for 1 second through a 21-step steptablet (manufactured and sold by Eastman Kodak Co., Ltd., U.S.A.) to light emitted from a tungsten lamp having a color temperature of 3,200° K. and filtered through a yellow color filter Y-50 (trade name of a color filter manufactured and sold by Tokyo Shibaura Electric Company Ltd., Japan). The exposed material was then heated on a hot plate maintained at about 120° C. for 5 seconds in the dark room to effect heat development.

Another piece of the dry image forming material was subjected to an accelerated deterioration test which was carried out under a light of 200,000 luxes for one hour by means of the fadeometer FX-1. The deteriorated material was subjected to image formation which was carried out in the same manner as described above.

The optical densities of the imaged materials respectively derived from the materials before and after subjected to the accelerated deterioration test were measured. The results evaluated in the terms of relative sensitivity, fogging and retention of sensitivity are shown in Table 1, in which (1), (4) and (11) indicates the aforementioned spectral sensitizing dye compounds listed under such numbers (such indications used hereinafter have the same meanings), and in which the standard material with a relative sensitivity of 100 is of Example 1.

TABLE 1

| | | Before Accelerated Deterioration | | After Accelerated Deterioration | |
|---|---|---|---|---|---|
| Run No. | Dye Compound | Relative Sensitivity | Fogging (O.D. min) | Retention of Sensitivity | Fogging (O.D. min) |
| Example 1 | (1) | 100 | 0.09 | 0.71 | 0.11 |
| Example 2 | (4) | 402 | 0.09 | 0.60 | 0.12 |
| Example 3 | (11) | 253 | 0.09 | 0.51 | 0.12 |
| Comparative Example 1 | none | 0 | 0.08 | 0 | 0.10 |
| Comparative Example 2 | (a) | 11 | 1.02 | 0 | 0.10 |

TABLE 1-continued

| Run No. | Dye Compound | Before Accelerated Deterioration: Relative Sensitivity | Before Accelerated Deterioration: Fogging (O.D. min) | After Accelerated Deterioration: Retention of Sensitivity | After Accelerated Deterioration: Fogging (O.D. min) |
|---|---|---|---|---|---|
| Comparative Example 3 | (b) | 5 | 0.60 | 0 | 0.10 |
| Comparative Example 4 | (c) | 12 | 1.2 | 0 | 0.10 |
| Comparative Example 5 | (d) | 12 | 1.0 | 0 | 0.10 |
| Comparative Example 6 | (e) | 5 | 0.20 | 0 | 0.10 |

The comparative dye compounds (a) to (e) used in Comparative Examples 2 to 6, respectively, are mentioned below.

(a)

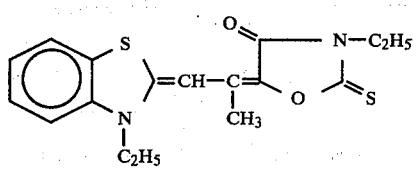

(mentioned in Japanese Patent Application Laid-Open Specification No. 137321/1977)

(b)

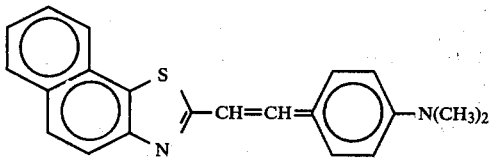

(mentioned in Japanese Patent Application Laid-Open Specification No. 17719/1974)

(c)

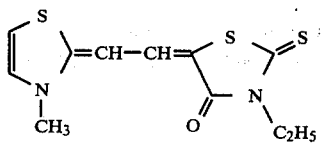

(mentioned in Japanese Patent Publication No. 41967/1978)

(d) 3-Allyl-5-[3-ethyl-(2-naphthoxazolidine)-ethylidene]-1-phenyl-2-thiohydantoin (mentioned in Japanese Patent Application Laid-Open Specification No. 51626/1973)

(e)

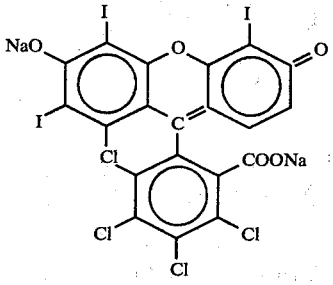

As is apparent from the results shown in Table 1, spectral sensitizing dye compounds (1), (4) and (11) used in the dry image forming materials of the present invention are by far superior in spectral sensitization, suppression of fogging in image forming materials before storage and retention of sensitivity of raw dry image forming material during storage thereof to the merocyanine, styryl and xanthene dyes, which, in addition to poor sensitization, develop a large fogging tendency in dry image forming materials at the steps of preliminary heating and heat development and do not contribute at all to promotion of retention of sensitivity of raw dry image forming materials during storage thereof.

EXAMPLES 4 TO 7 AND COMPARATIVE EXAMPLES 7 TO 12

To 1.5 g of a silver behenate suspension as prepared in the same manner as in Examples 1 to 3 and Comparative Examples 1 to 6 were added ingredients [III] as shown below to form a silver behenate emulsion. The silver behenate emulsion was applied onto a 100 μ-thick polyethylene terephthalate film and air-dried in the same manner as in Examples 1 to 3 and Comparative Examples 1 to 6 to form a first coating layer. About 2 g of a reducing agent-containing composition composed of ingredients [IV] as shown below was uniformly applied as a second coating layer and air-dried in the same manner as in Examples 1 to 3 and Comparative Examples 1 to 6 to obtain a dry image forming material.

| | |
|---|---|
| **Ingredients [III]** | |
| 15 Weight % solution of polyvinyl butyral in methyl ethyl ketone | 1.3 g |
| Solution of 100 mg of mercuric iodide in 9 cc of acetone | 0.5 cc |
| 2,2,2-Tribromoethanol | 45 mg |
| N-Iodosuccinimide | 6.3 mg |
| Cobalt dibromide | 3 mg |
| 1-Phenyl-2,3-dimethyl-3-pyrazolin-5-one | 20 mg |
| Solution of 10 mg of dye compound as indicated in Table 2 in 10 cc of methanol | 0.2 cc |
| **Ingredients [IV]** | |
| Cellulose acetate | 6.3 g |
| 2,4,4-Trimethylpentylbis(2-hydroxy-3,5-dimethylphenyl)methane | 2.8 g |
| Phthalazinone | 1.2 g |
| Acetone | 83.0 g |

The relative sensitivity, fogging and retention of sensitivity of the dry image forming material were examined in the same manner as in Examples 1 to 3 and Comparative Examples 1 to 6, and were found to be as shown in Table 2, in which the standard material with a relative sensitivity of 100 is of Example 4.

TABLE 2

| Run No. | Dye Compound | Before Accelerated Deterioration: Relative Sensitivity | Before Accelerated Deterioration: Fogging (O.D. min) | After Accelerated Deterioration: Retention of Sensitivity | After Accelerated Deterioration: Fogging (O.D. min) |
|---|---|---|---|---|---|
| Example 4 | (2) | 100 | 0.09 | 0.69 | 0.11 |
| Example 5 | (5) | 102 | 0.09 | 0.71 | 0.11 |
| Example 6 | (7) | 205 | 0.09 | 0.95 | 0.11 |
| Comparative Example 7 | none | 0 | 0.08 | — | 0.10 |
| Comparative Example 8 | (f) | 0 | 1.02 | — | 0.30 |

TABLE 2-continued

| Run No. | Dye Compound | Before Accelerated Deterioration: Relative Sensitivity | Before Accelerated Deterioration: Fogging (O.D. min) | After Accelerated Deterioration: Retention of Sensitivity | After Accelerated Deterioration: Fogging (O.D. min) |
|---|---|---|---|---|---|
| Comparative Example 9 | (g) | 31 | 0.62 | — | 0.31 |
| Comparative Example 10 | (h) | 40 | 0.40 | 0.10 | 0.25 |
| Comparative Example 11 | (i) | 52 | 0.31 | 0.21 | 0.20 |
| Comparative Example 12 | (j) | 0 | 0.31 | — | 0.31 |

The comparative dye compounds (f) to (j) used in Comparative Examples 8 to 12, respectively, are mentioned below.

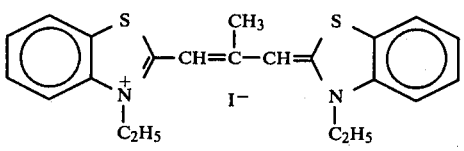
(f)

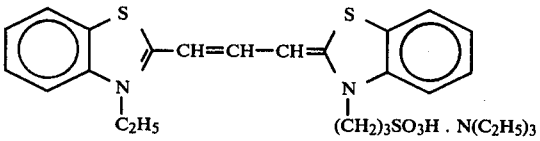
(g)

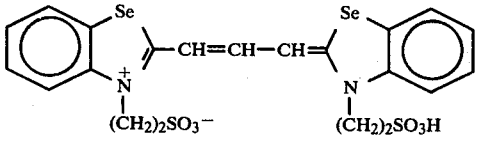
(h)

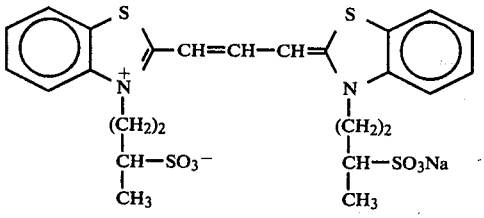
(i)

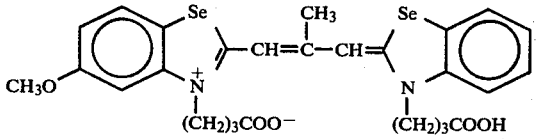
(j)

As is apparent from the results shown in Table 2, the disulfopropyl type spectral sensitizing dye compounds (2), (5) and (7) used in the dry image forming materials of the present invention are by far superior in spectral sensitization, suppression of fogging at the steps of preliminary heating and heat development of materials before storage, retention of sensitivity of raw materials, and suppression of fogging in materials after storage to the monosulfopropyl type, non-sulfoalkyl type, disulfoethyl type, di-3-sulfobutyl type and dicarboxypropyl type dyes.

EXAMPLES 8 TO 12 AND COMPARATIVE EXAMPLES 13 TO 17

A dry image forming material was prepared in substantially the same manner as in Examples 4 to 7 and Comparative Examples 7 to 12 except that a dye compound as indicated in Table 3 was used instead of that in ingredients [III].

The relative sensitivity, fogging and retention of sensitivity of the dry image forming material were examined in substantially the same manner as in Examples 1 to 3 and Comparative Examples 1 to 6 except that the light exposure was carried out for 8 seconds by using a light with a wavelength of 480 nm emitted from a monochrometer, and were found to be as shown in Table 3, in which the standard material with a relative sensitivity of 100 is of Example 8.

TABLE 3

| Run No. | Dye Compound | Before Accelerated Deterioration: Relative Sensitivity | Before Accelerated Deterioration: Fogging (O.D. min) | After Accelerated Deterioration: Retention of Sensitivity | After Accelerated Deterioration: Fogging (O.D. min) |
|---|---|---|---|---|---|
| Example 8 | (15) | 100 | 0.09 | 0.60 | 0.10 |
| Example 9 | (17) | 152 | 0.09 | 0.95 | 0.10 |
| Example 10 | (18) | 123 | 0.09 | 0.61 | 0.21 |
| Example 11 | (19) | 151 | 0.09 | 0.52 | 0.10 |
| Example 12 | (20) | 173 | 0.09 | 0.51 | 0.10 |
| Comparative Example 13 | none | 0 | 0.09 | — | 0.10 |
| Comparative Example 14 | (k) | 0 | 1.10 | — | 0.31 |
| Comparative Example 15 | (l) | 0 | 1.00 | — | 0.30 |
| Comparative Example 16 | (m) | 0 | 0.09 | — | 0.10 |
| Comparative Example 17 | (n) | 12 | 0.09 | 0.10 | 0.12 |

The comparative dye compounds (k) to (n) used in Comparative Examples 14 to 17, respectively, are mentioned below.

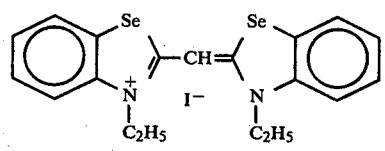
(k)

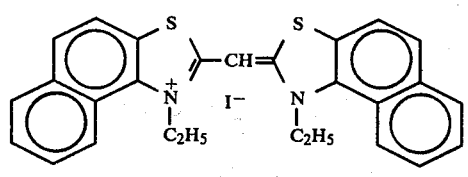
(l)

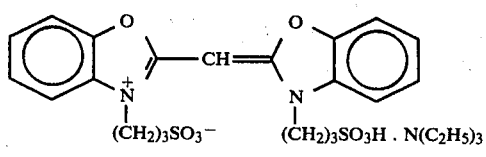
(m)

-continued (n)

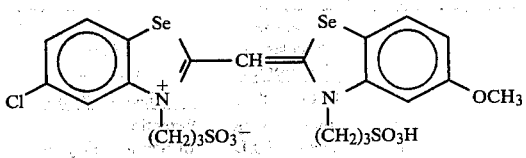

As is apparent from the results shown in Table 3, the disulfopropyl type spectral sensitizing dye compounds (15), (17), (18), (19) and (20) used in the dry image forming materials of the present invention are by far superior in spectral sensitization, suppression of fogging at the steps of preliminary heating and heat development of materials before storage, retention of sensitivity of raw materials and suppression of fogging in materials after storage to the non-sulfoalkyl type dyes, and superior in spectral sensitization and retention of sensitivity of raw dry image forming materials during storage thereof to even the disulfopropyl type dyes of the formulae similar to but different from the formula (III). The dye compound (m) has oxygen atoms at the positions corresponding to the Z position in the formula (III). The dye compound (n) has a methoxy group at one of the positions corresponding to the R positions in the formula (III).

EXAMPLES 13 TO 18 AND COMPARATIVE EXAMPLES 18 TO 22

To 20 g of a mixed solvent of toluene and methyl ethyl ketone (mixing weight ratio = 1:2) was added 3.5 g of silver stearate, and the mixture was ball-milled for about 18 hours to obtain a homogeneous silver stearate suspension.

To 1.5 g of the silver stearate suspension were added ingredients [V] as shown below to form a silver stearate emulsion. The silver stearate emulsion was applied onto a 100μ-thick polyethyrene terephthalate film and air-dried in the same manner as in Examples 1 to 3 and Comparative Examples 1 to 6 to form a first coating layer. About 2 g of a reducing agent-containing composition composed of ingredients [VI] as shown below was applied as a second coating layer and air-dried in the same manner as in Examples 1 to 3 and Comparative Examples 1 to 6 to obtain a dry image forming material.

| Ingredients [V] | | |
|---|---|---|
| 15 Weight % solution of polyvinyl butyral methyl ethyl ketone | 1.3 | g |
| N-Iodosuccinimide | 6.3 | mg |
| Diphenylbromomethane | 4.0 | mg |
| Solution of 10 mg of mercuric acetate in 3 cc of methanol | 0.15 | cc |
| α,α,α',α'-Tetrabromo-m-xylene | 30 | mg |
| Solution of 1 mg of dye compound as indicated in Table 4 in 1 cc of methanol | 0.1 | cc |
| **Ingredients [VI]** | | |
| Polymethyl methacrylate | 6.3 | g |
| 2,2'-Methylenebis(4-ethyl-6-tert-butylphenol) | 3.5 | g |
| Phthalazinone | 1.2 | g |
| Methyl ethyl ketone | 83.0 | g |

The relative sensitivity, fogging and retention of sensitivity of the dry image forming material were examined in the same manner as in Examples 1 to 3 and Comparative Examples 1 to 6, and were found to be as shown in Table 4, in which the standard material with a relative sensitivity of 100 is of Example 13.

TABLE 4

| Run No. | Dye Compound | Before Accelerated Deterioration: Relative Sensitivity | Before Accelerated Deterioration: Fogging (O.D. min) | After Accelerated Deterioration: Retention of Sensitivity | After Accelerated Deterioration: Fogging (O.D. min) |
|---|---|---|---|---|---|
| Example 13 | (1) | 100 | 0.11 | 0.61 | 0.20 |
| Example 14 | (4) | 400 | 0.11 | 0.72 | 0.12 |
| Example 15 | (3) | 200 | 0.11 | 0.90 | 0.12 |
| Example 16 | (7) | 200 | 0.11 | 0.96 | 0.12 |
| Example 17 | (11) | 250 | 0.11 | 0.53 | 0.12 |
| Example 18 | (22) | 150 | 0.11 | 0.60 | 0.12 |
| Comparative Example 18 | none | 0 | 0.08 | — | 0.11 |
| Comparative Example 19 | (o) | 100 | 0.11 | 0.18 | 0.28 |
| Comparative Example 20 | (p) | 70 | 0.11 | 0.11 | 0.50 |
| Comparative Example 21 | (q) | 50 | 0.11 | 0.10 | 0.31 |
| Comparative Example 22 | (r) | 100 | 0.11 | 0 | 0.15 |

The comparative dye compounds (o) to (r) used in Comparative Examples 19 to 22, respectively, are mentioned below.

(o)

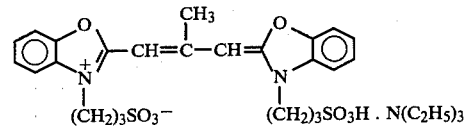

(p)

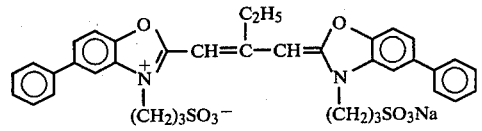

(mentioned in Japanese Patent Application Laid-Open Specification No. 17719/1974)

(q)

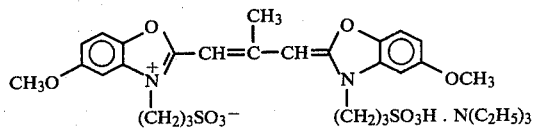

-continued

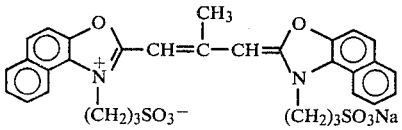

(r)

As is apparent from the results shown in Table 4, the spectral sensitizing dye compounds (1), (4), (3), (7), (11) and (22) respectively employed in the dry image forming materials of the present invention are superior in spectral sensitization, retension of spectral sensitivity of raw materials during storage thereof, and suppression of fogging in materials stored under lighting conditions to those comparative dye compounds employed in Comparative Examples 19 to 22, which have a benzoxazole skeletal structure.

EXAMPLES 19 TO 22 AND COMPARATIVE EXAMPLES 23 TO 28

To 1.5 g of a silver behenate suspension as prepared in the same manner as in Examples 1 to 3 and Comparative Examples 1 to 6 were added ingredients [VII] as shown below to form a silver behenate emulsion. The silver behenate emulsion was applied onto a 100μ-thick polyethylene terephthalate film and air-dried in the same manner as in Examples 1 to 3 and Comparative Examples 1 to 6 to form a first coating layer. About 2 g of a reducing agent-containing composition composed of ingredients [VI] as used in Examples 13 to 18 and Comparative Examples 18 to 22 was applied as a second coating layer and air-dried in the same manner as in Examples 1 to 3 and Comparative Examples 1 to 6 to obtain a dry image forming material.

| Ingredients [VII] | |
|---|---|
| 15 Weight % solution of polyvinyl butyral in methyl ethyl ketone | 1.3 g |
| Solution of 100 mg of mercuric acetate in 3 cc of methanol | 0.15 cc |
| Iodine | 8 mg |
| Triphenyl phosphite | 4 mg |
| Diphenylbromomethane | 4 mg |
| 1-Phenyl-2,3-dimethyl-3-pyrazolin-5-one | 30 mg |
| α,α,α', α'-Tetrabromo-o-xylene | 35 mg |
| Solution of 10 mg of dye compound as indicated in Table 5 in 10 cc methanol | 0.15 cc |

The relative sensitivity, fogging and retention of sensitivity of the dry image forming material were examined in substantially the same manner as in Examples 1 to 3 and Comparative Examples 1 to 6 except that the accelerated deterioration test was carried out by passing the raw material 50 times through the microfiche duplicator, and were found to be as shown in Table 5, in which the standard material with a relative sensitivity of 100 is of Example 19.

TABLE 5

| Run No. | Dye Compound | Before Accelerated Deterioration: Relative Sensitivity | Before Accelerated Deterioration: Fogging (O.D. min) | After Accelerated Deterioration: Retention of Sensitivity | After Accelerated Deterioration: Fogging (O.D. min) |
|---|---|---|---|---|---|
| Example 19 | (5) | 100 | 0.09 | 0.85 | 0.10 |
| Example 20 | (3) | 200 | 0.09 | 1.0 | 0.10 |

TABLE 5-continued

| Run No. | Dye Compound | Before Accelerated Deterioration: Relative Sensitivity | Before Accelerated Deterioration: Fogging (O.D. min) | After Accelerated Deterioration: Retention of Sensitivity | After Accelerated Deterioration: Fogging (O.D. min) |
|---|---|---|---|---|---|
| Example 21 | (11) | 250 | 0.09 | 0.80 | 0.10 |
| Example 22 | (23) | 80 | 0.09 | 0.57 | 0.10 |
| Comparative Example 23 | (s) | 40 | 0.09 | 0.30 | 0.20 |
| Comparative Example 24 | (t) | 60 | 0.09 | 0.20 | 0.21 |
| Comparative Example 25 | (u) | 20 | 0.09 | 0.1 | 0.20 |
| Comparative Example 26 | (v) | 5 | 0.09 | 0.1 | 0.25 |
| Comparative Example 27 | (w) | 10 | 0.09 | 0.1 | 0.18 |
| Comparative Example 28 | (x) | 30 | 0.17 | 0.1 | 0.17 |

The comparative dye compounds (s) to (x) used in Comparative Examples 23 to 28, respectively, are mentioned below.

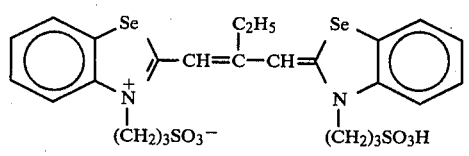

(s)

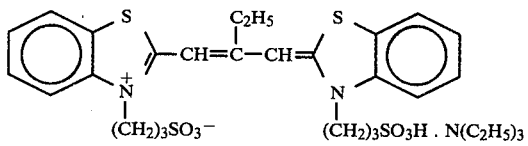

(t)

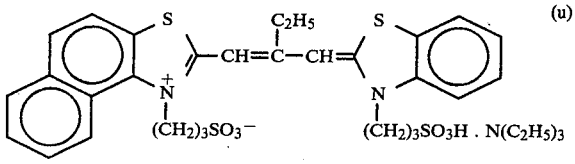

(u)

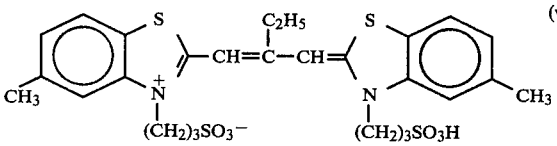

(v)

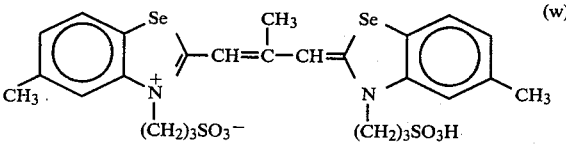

(w)

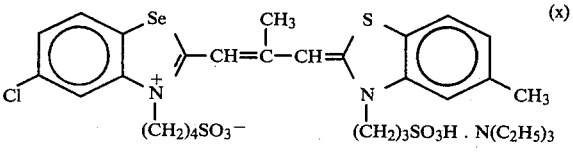

(x)

As is apparent from the results shown in Table 5, the spectral sensitizing dye compounds (5), (3), (11) and (23) used in the dry image forming materials of the present invention are superior in retension of spectral sensitivity of raw materials and suppression of fogging in materials after storage as well as spectral sensitization to the comparative dye compounds similar to but different from those specified in the present invention. The dye compounds (s) to (v) have an ethyl group at the meso-position corresponding to the Y position in the formula (I) or (II). The dye compounds (v) to (x) has, as the substituent(s) of the benzthiazole ring or benzselenazole ring, one or two methyl groups at one or both of the positions corresponding to the R positions in the formula (I).

EXAMPLES 23 TO 27 AND COMPARATIVE EXAMPLE 29

To 1.5 g of a silver behenate suspension as prepared in the same manner as in Example 1 were added ingredients [VIII] as shown below to form a silver behenate emulsion. The silver behenate emulsion was applied onto a 100μ-thick polyethylene terephthalate film and air-dried in the same manner as in Examples 1 to 3 and Comparative Examples 1 to 6 to form a first coating layer. About 2 g of a reducing agent-containing composition composed of ingredients [IX] as shown below was applied as a second coating layer and air-dried in the same manner as in Examples 1 to 3 and Comparative Examples 1 to 6 to obtain a dry image forming material.

| Ingredients [VIII] | |
|---|---|
| 15 Weight % solution of polyvinyl butyral in methyl ethyl ketone | 1.3 g |
| Solution of 100 mg of mercuric acetate in 3 cc of methanol | 0.15 cc |
| α,α,α',α'-Tetrabromo-o-xylene | 25 mg |
| Triphenyl phosphite | 3 mg |
| Iodine | The amount is indicated in Table 6. |
| Diphenylbromomethane | The amount is indicated in Table 6. |
| 1-Phenyl-2-methyl-3-phenyl-3-pyrazolin-5-one | 35 mg |
| Solution of 1 mg of dye compound (7) in 1 cc methanol | 0.1 cc |
| **Ingredients [IX]** | |
| Cellulose acetate | 6.3 mg |
| 2,2'-methylenebis(4-ethyl-6-tert-buthylphenol) | 3.5 g |
| Phthalazinone | 1.2 g |
| Acetone | 83.0 g |

The relative sensitivity, fogging and retention of sensitivity of the dry image forming material were examined in the same manner as in Examples 1 to 3 and Comparative Examples 1 to 6, and were found to be as shown in Table 6, in which the standard material with a relative sensitivity of 100 is of Example 23.

TABLE 6

| Run No. | Halogenating Agent: Iodine (mg) | Halogenating Agent: Diphenylbromomethane (mg) | Molar Ratio of I/Br | Before Accelerated Deterioration: Relative Sensitivity | Before Accelerated Deterioration: Fogging (O.D. min) | After Accelerated Deterioration: Retention of Sensitivity | After Accelerated Deterioration: Fogging (O.D. min) |
|---|---|---|---|---|---|---|---|
| Example 23 | 8 | 4 | 79/21 | 100 | 0.09 | 0.93 | 0.11 |
| Example 24 | 9.4 | 1 | 95/5 | 50 | 0.09 | 0.90 | 0.11 |
| Example 25 | 4.9 | 9.3 | 51/49 | 130 | 0.09 | 0.87 | 0.11 |
| Example 26 | 12 | 0 | 100/0 | 10 | 0.15 | 0.40 | 0.11 |
| Example 27 | 3.1 | 13.5 | 31/69 | 120 | 0.09 | 0.90 | 0.18 |
| Comparative Example 29 | 0 | 24 | 0/100 | 10 | 0.09 | 0 | 1.8 |

As is apparent from the results shown in Table 6, it is necessary from the viewpoint of raw materials that the silver halide-forming component include silver iodide-forming compound so that the silver halide component formed therefrom includes silver iodide.

EXAMPLES 28 AND 29 AND COMPARATIVE EXAMPLE 30

To 1.5 g of a silver behenate suspension as prepared in the same manner as in Examples 1 to 3 and Comparative Examples 1 to 6 were added ingredients [X] as shown below to form a silver behenate emulsion. The silver behenate emulsion was applied onto a 100μ-thick polyethylene terephthalate film and air-dried in substantially the same manner as in Examples 1 to 3 and Comparative Examples 1 to 6 to form a first coating layer. A composition composed of ingredients [VI] as used in Examples 13 to 18 and Comparative Examples 18 to 22 was applied as a second coating layer and air-dried in substantially the same manner as in Examples 1 to 3 and Comparative Examples 1 to 6 to obtain a dry image forming material.

| Ingredients [X] | |
|---|---|
| 15 Weight % solution of polyvinyl butyral in methyl ethyl ketone | 1.3 g |
| Iodine | 15 mg |
| Triphenyl phosphite | 4 mg |
| Nickel dibromide | 5 mg |
| Solution of 1 mg of dye compound (3) in 1 cc of methanol | 0.1 cc |
| Compound(s) indicated as the component (d) and/or (e) in Table 7 | The amount(s) is(are) indicated in Table 7. |

The relative sensitivity, fogging and retention of sensitivity of the dry image forming material were examined in the same manner as in Examples 1 to 3 and Comparative Examples 1 to 6, and were found to be as shown in Table 7, in which the standard material with a relative sensitivity of 100 is of Comparative Example 30.

TABLE 7

| Run No. | Component (d) | Component (e) | Before Accelerated Deterioration: Relative Sensitivity | Before Accelerated Deterioration: Fogging (O.D. min) | After Accelerated Deterioration: Retention of Sensitivity | After Accelerated Deterioration: Fogging (O.D. min) |
|---|---|---|---|---|---|---|
| Example 28 | Co(III) | α,α,α',α'- | 90 | 0.15 | 0.80 | 0.18 |

TABLE 7-continued

| Run No. | Component (d) | Component (e) | Before Accelerated Deterioration | | After Accelerated Deterioration | |
|---|---|---|---|---|---|---|
| | | | Relative Sensitivity | Fogging (O.D. min) | Retention of Sensitivity | Fogging (O.D. min) |
| | acetylacetonate 5 mg | tetrabromo-o-xylene 25 mg | | | | |
| Example 29 | Pd(II) acetylacetonate 5 mg | α,α,α',α'-tetrabromo-o-xylene 25 mg | 80 | 0.13 | 0.76 | 0.23 |
| Comparative Example 30 | Mercuric acetate 5 mg | none | 100 | 0.09 | 0 | 1.8 |

EXAMPLE 30

To 1.5 g of a silver behenate suspension as prepared in the same manner as in Examples 1 to 3 and Comparative Examples 1 to 6 were added ingredients [XI] as shown below to form a silver behenate emulsion. The silver behenate emulsion was applied onto a 100μ-thick polyethylene terephthalate film and air-dried in substantially the same manner as in Examples 1 to 3 and Comparative Examples 1 to 6 to form a first coating layer. A composition composed of ingredients [IX] as used in Examples 23 to 27 and Comparative Example 29 was applied as a second coating layer and air-dried in the same manner as in Examples 1 to 3 and Comparative Examples 1 to 6 to obtain a dry image forming material.

| Ingredients [XI] | |
|---|---|
| 15 Weight % solution of polyvinyl butyral in methyl ethyl ketone | 1.3 g |
| Solution of 100 mg of mercuric acetate in 3 cc of methanol | 0.15 cc |
| Silver Iodide | 8.2 mg |
| Silver bromide | 1.2 mg |
| α,α,α',α'-Tetrabromobutane | 30 mg |
| 1-Phenyl-2-methyl-3-phenyl-3-pyrazolin-5-one | 35 mg |
| Solution of 1 mg of dye compound (7) in 1 cc of methanol | 0.1 cc |

The sensitivity, fogging and retention of sensitivity of the dry image forming material were examined in the same manner as in Examples 1 to 3 and Comparative Examples 1 to 6. The sensitivity of the material was a tenth that of the material of Example 23. However, the fogging and stability of the raw material were substantially the same as those of the material of Example 23.

EXAMPLE 31 AND COMPARATIVE EXAMPLE 31

To 1.5 g of a silver behenate suspension as prepared in the same manner as in Examples 1 to 3 and Comparative Examples 1 to 6 were added ingredients [XII] as shown below to form a silver behenate emulsion. The silver behenate emulsion was applied onto a 100μ-thick polyethylene terephthalate film and air-dried in substantially the same manner as in Examples 1 to 3 and Comparative Examples 1 to 6 to form a first coating layer. A composition composed of ingredients [VI] as used in Examples 13 to 18 and Comparative Examples 18 to 22 was applied as a second coating layer and air-dried in the same manner as in Examples 1 to 3 and Comparative Examples 1 to 6 to obtain a dry image forming material.

| Ingredients [XII] | |
|---|---|
| 15 Weight % solution of polyvinyl butyral in methyl ethyl ketone | 1.3 g |
| Solution of 100 mg of mercuric acetate in 3 cc of methanol | 0.15 cc |
| Triphenyl phosphite | 4 mg |
| Iodine | 8 mg |
| Cobalt dibromide | 5 mg |
| 1-Phenyl-2,3-dimethyl-3-pyrazolin-5-one | 20 mg |
| 2,2,2-Tribromoethanol | 30 mg |
| Solutions of 10 mg each of dye compounds as indicated in Table 8 in 10 cc of methanol | The amounts are indicated in Table 8. |

A piece of dry image forming material was subjected to spectrographic analysis by means of a spectrograph (manufactured by Narumi Shokai, Japan) to obtain a spectral sensitivity curve.

TABLE 8

| Run No. | Dye Compound | Spectral Sensitivity Curve |
|---|---|---|
| Example 31 | (3) + (17) 0.1 cc 0.2 cc | FIG. 1 |
| Comparative Example 31 | none | FIG. 2 |

As is apparent from the spectral sensitivity curves shown in FIG. 1 and FIG. 2, the combined use of the dye compounds (3) and (17) is effective for achieving, in the dry image forming material, well balanced spectral sensitization over the wide range of wavelengths of light.

Another piece of the dry image forming material of Example 31 was heat-activated at 100° C. for 3 seconds. Under the light of a fluorescent lamp, three manuscripts having a black image on each of a light-green, a light-yellow and a pink backgrounds were photographed on the activated material. The resulting material was heat-developed at 125° C. for 3 seconds. The images obtained were all very clear.

What is claimed is:

1. A post-activation type dry image forming material comprising:

(a) a silver salt of long chain fatty acid having 16 or more carbon atoms;

(b) a reducing agent for silver ions;

(c) a silver halide component including silver iodide or a silver halide-forming component capable of forming a silver halide component including silver iodide by the reaction thereof with said silver salt of long chain fatty acid (a);

(d) an oxidizing agent for free silver;

(e) a photoreactive halogeno oxidizing agent;

(f) a binder; and (g) a spectral sensitizing dye consisting of at least one member selected from the group consisting of those compounds represented by the following formulae:

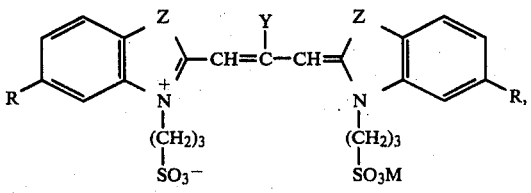

(I)

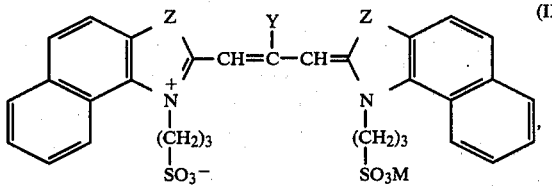

(II)

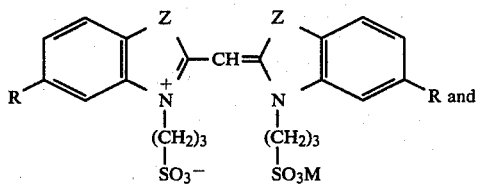

(III)

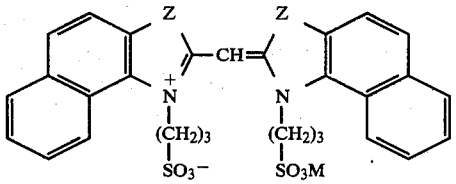

(IV)

wherein each Z independently is sulfur or selenium, Y is hydrogen or methyl, each R independently is hydrogen or chlorine, and M is hydrogen, $HN(C_2H_5)_3$ or sodium.

2. A post-activation type dry image forming material as claimed in claim 1, wherein the component (g) comprises a compound represented by the following formula:

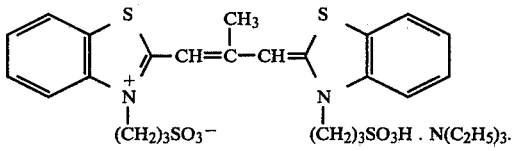

3. A post-activation type dry image forming material as claimed in claim 1, wherein the component (g) comprises a compound represented by the following formula:

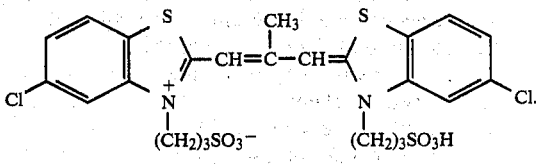

4. A post-activation type dry image forming material as claimed in claim 1, wherein the component (g) comprises a compound represented by the following formula:

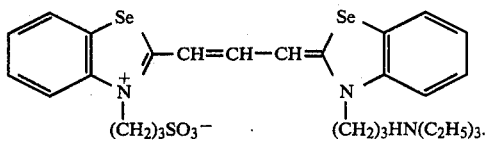

5. A post-activation type dry image forming material as claimed in claim 1, wherein the component (g) comprises a compound represented by the following formula:

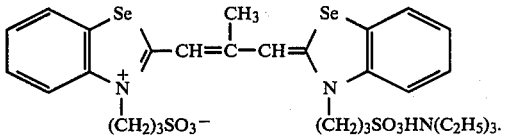

6. A post-activation type dry image forming material as claimed in claim 1, wherein the component (g) comprises a compound represented by the following formula:

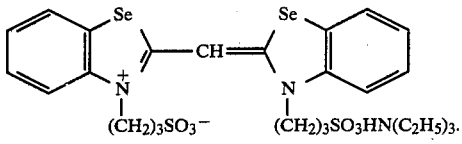

7. A post-activation type dry image forming material as claimed in claim 1, wherein the component (g) comprises a compound represented by the following formula:

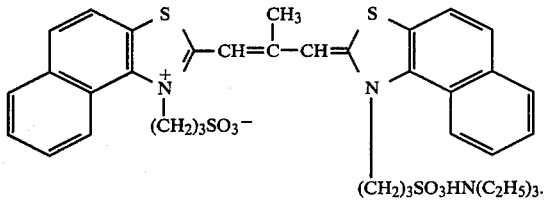

8. A post-activation type dry image forming material as claimed in any one of claims 1 to 7, wherein the amount of the component (g) is 0.001 to 1 mole % based on the component (a).

9. A post-activation type dry image forming material as claimed in claim 1, wherein the component (a) is silver behenate, and is present in an amount of 1 to 10 g per $m^2$ of the area of the material.

10. A post-activation type dry image forming material as claimed in claim 1, wherein the component (b) is a hindered phenol, and is present in an amount of 0.1 to 3 moles per mole of the component (a).

11. A post-activation type dry image forming material as claimed in claim 1, wherein the silver halide component (c) or the silver halide component formed from the silver halide-forming component (c) is a mixture of mixed crystals of silver iodide and silver bromide, the molar ratio of silver iodide to silver bromide being 30/70 to 98/2.

12. A post-activation type dry image forming material as claimed in claim 11, wherein said molar ratio is 50/50 to 95/5.

13. A post-activation type dry image forming material as claimed in any one of claims 1, 11 and 12, wherein the amount of the silver halide component (c) or the silver halide component formed from the silver halide-forming component (c) is 0.1 to 20 mole % based on the component (a).

14. A post-activation type dry image forming material as claimed in claim 1, wherein the silver halide-forming component (c) is an organic halide of an element selected from Ge, Sn, P, Bi, Te and Se.

15. A post-activation type dry image forming material as claimed in claim 1, wherein the silver halide-forming component (c) is an organic N-haloamide containing a unit of the formula —CONX— wherein X is bromine or iodine.

16. A post-activation type dry image forming material as claimed in claim 1, wherein the silver halide-forming component (c) is a halogen molecular species or a complex thereof.

17. A post-activation type dry image forming material as claimed in claim 1, wherein the silver halide-forming component (c) is at least one member selected from $CoX_2$, $NiX_2$, $MgX_2$, $BaX_2$, RbX, CsX, $TeX_2$, $TeX_4$, and $AsX_3$, wherein X is bromine or iodine.

18. A post-activation type dry image forming material as claimed in claim 1, wherein the silver halide-forming component (c) is at least one member selected from iodine, complexes of iodine, N-iodosuccinimide, N-bromosuccinimide, cobalt dibromide, nickel dibromide and α-bromodiphenylmethane.

19. A post-activation type dry image forming material as claimed in claim 1, wherein the component (d) is at least one member selected from compounds of divalent mercury, compounds of trivalent iron, compounds of trivalent cobalt, compounds of divalent palladium and sulfinic acid compounds.

20. A post-activation type dry image forming material as claimed in claim 19, wherein the component (d) is at least one member selected from mercuric acetate, mercuric bromide, mercuric iodide, Co(III) acetylacetonate and Pd(II) acetylacetonate.

21. A post-activation type dry image forming material as claimed in any one of claims 1, 19 and 20, wherein the amount of the component (d) is 0.01 to 10 mole % based on the component (a).

22. A post-activation type dry image forming material as claimed in claim 1, wherein the component (e) is a halogenated organic compound having bromine- and/or iodine-carbon linkages and satisfying the two requirements as herein defined with respect to the photoreaction test herein described.

23. A post-activation type dry image forming material as claimed in claim 22, wherein the component (e) is at least one member selected from α,α,α′,α′-tetrabromo-o-xylene, α,α,α′,α′-tetrabromo-m-xylene, ethyl α,α,α-tribromoacetate, α,α,α-tribromo-p-bromotoluene, α,α,α-tribromoacetophenone, 1,1,1-tribromo-2,2-diphenylethane, 2,2,2-tribromoethanol and meso-1,2,3,4-tetrabromobutane.

24. A post-activation type dry image forming material as claimed in any one of claims 1, 22 and 23, wherein the amount of the component (e) is 2.5 to 40 mole % based on the component (a).

25. A post-activation type dry image forming material as claimed in claim 1, wherein the component (f) is polyvinyl butyral, and is present in such an amount that the weight ratio of the component (f) to the component (a) is in the range of from about 0.1 to about 10.

* * * * *

UNITED STATES PATENT AND TRADEMARK OFFICE

CERTIFICATE OF CORRECTION

PATENT NO. : 4,332,889

DATED : June 1, 1982

INVENTOR(S) Tetsuo Shiga et al

It is certified that error appears in the above-identified patent and that said Letters Patent is hereby corrected as shown below:

Title page, (19) U.S. delete "Siga" and insert -- Shiga --

Title page,(17) Inventors, after "Tetsuo" delete "Siga" and insert -- Shiga --

Column 6, line 24, "contiquous" should read -- contiguous --.

Column 22, line 3, after "butyral" insert -- in --

Column 26, line 21, after "viewpoint of" insert -- stabiltiy of --

Signed and Sealed this

*Twenty-third* Day of *November 1982*

[SEAL]

*Attest:*

GERALD J. MOSSINGHOFF

*Attesting Officer* *Commissioner of Patents and Trademarks*